United States Patent [19]

Dennis

[11] 4,305,517

[45] Dec. 15, 1981

[54] TAMPERPROOF CLOSURE

[75] Inventor: Stanley W. Dennis, Baltimore, Md.

[73] Assignee: Deniseal, Inc., Baltimore, Md.

[21] Appl. No.: 165,355

[22] Filed: Jul. 2, 1980

[51] Int. Cl.[3] ..... B65D 41/48

[52] U.S. Cl. ..... 215/256

[58] Field of Search ..... 215/256; 220/270

[56] References Cited

U.S. PATENT DOCUMENTS

| | | | |
|---|---|---|---|
| 3,753,511 | 8/1973 | Ruch | 215/256 |
| 3,913,771 | 10/1975 | Acton | 215/256 |
| 4,066,181 | 1/1978 | Robinson et al. | 215/256 |
| 4,103,803 | 8/1978 | Irvine | 215/256 X |
| 4,166,552 | 9/1979 | Faulstich | 215/256 |

*Primary Examiner*—Donald F. Norton

*Attorney, Agent, or Firm*—LeBlanc, Nolan, Shur & Nies

[57] ABSTRACT

A tamperproof push-on type integral synthetic plastic closure cap for an externally beaded container neck, the cap comprising a body having a depending side wall, a rim on the lower end of the wall having an inwardly projecting locking rib adapted to coact with a bead on the container neck, a circumferential weakened region in the wall disposed above the rim, and a tab projecting outwardly from the rim, the wall having a slotted region adjacent the inner end of the tab and there being a weakened connecting region formed by a notch between the rim and the inner corner of the tab so that twisting the tab will break the rim at the notched region and enable the rim to be detached from the side wall along the circumferential region by outward pull on the tab.

9 Claims, 8 Drawing Figures

TAMPERPROOF CLOSURE

This invention relates to tamperproof closures and particularly to tamperproof closure caps for containers of milk, fruit juice, spring water or like liquids of the type wherein at least part of the cap must be destroyed in order to allow an installed cap to be removed from the container.

In its preferred embodiment the invention will be described as incorporated in an integral synthetic plastic closure cap adapted to be axially pushed onto the externally ribbed or beaded neck of a container where it effectively locks to the container and cannot be removed until a portion of the cap wall containing a coacting locking rib is detached.

It has become quite common to market milk, spring water and fruit juice in gallon jug-like containers which are blow molded from parisons of polyethylene or equivalent inert plastic, with reduced diameter filling and pouring necks at the top. The necks are externally provided with formation adapted to coact with closure caps, and a common mode is to provide one or two revolution external thread formation on the neck with the closure cap correspondingly internally threaded. The containers are of relatively light weight but sturdy enough to retain shape when filled, and the closure caps are usually integrally molded synthetic plastic members of sufficient inherent resilience to compensate for irregularities in thread form or fit.

It is often desirable to provide for tamperproof installation of these screw type closure caps, to prevent unauthorized access to the liquid in a filled container, and various structural arrangments have been proposed as disclosed in U.S. Pats. No. 3,504,818 to Crispi, No. 3,812,994 to Feldman and No. 4,098,419 Virog, Jr. et al. These devices usually require special coacting locking formations on the cap and on the container at or near the container neck in addition to the mounting threads, and usually the cap is deformed or at least partially destroyed to detach the locking formations from the cap when the cap is to be first removed from the container.

Other widely used containers do not use threaded closure caps. These container necks are formed with one or more parallel external beads and the closure caps are synthetic plastic members internally formed with a locking rib or ribs that may cam over the neck bead structure as the cap is axially pushed to a snap fit onto the container neck, with one rib eventually disposed in locking relation under a container bead so that the cap cannot be removed without disposing of this locking condition. An advantage of this push-on type of cap over the screw-on type is that there is no need to control torque in applying the cap to a container, as a simple downward push sealingly seats the cap on the container neck. In such caps as disclosed for example in the U.S. Pat. No. Faulstich Nos. 3,120,900; 3,338,446; 3,392,862 and 3,608,765, a tear strip arrangment may be provided whereby the protion of the cap wall containing the locking rib is detached from the cap to enable the cap to be removed from the container neck.

The invention herein is directed to tamperproof closure caps for containers of the above mentioned push-on type, and it is the major object of the invention to provide caps having a novel detachable locking rib arrangment.

A further object of the invention is to provide a novel tamperproof closure cap adapted to be pushed into locked condition on an externally beaded container neck, with an internal locking rib of the cap formed on the lower rim portion of the cap side wall and adapted to be disposed in locked position under a neck bead, wherein the cap wall is provided with a circumferential weakened region above the rim and a release tab that extends outwardly from the rim has a weakened connection to the rim at one side, whereby to render an installed cap removable from the container the tab may be manipulated to rupture its weakened side connection with the rim while the other side remains fixed to the rim and subsequent outward pull on the tab tears the cap side wall along the circumferential weakened section and separates the rim entirely from the cap.

A further object of the invention is to provide a tamperproof cap for a container wherein a lower rim of the cap side wall is formed with substantially annular inwardly projecting locking rib and there is a circumferentially weakened wall region above the rib, there being a release tab extending outwardly from the rim having a weakened connection at one side to the rim, and the cap side wall being slotted in line with said weakened region at the inner end of said tab.

PREFERRED EMBODIMENTS

Figure 1:
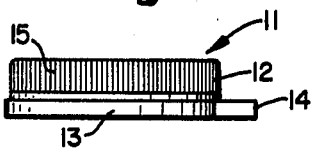
FIG. 1 is a side elevation of a container closure cap according to a preferred embodiment.

FIG. 1 illustrates a closure cap 11 which is an integral synthetic plastic member consisting essentially of a cup-shaped body 12 having a detachable annular rim 13 around its lower end. A release tab 14 extends radially from rim 13 for manual manipulation when the cap is to be removed from a container. The body may be peripherally grooved as at 15 for ease in handling.

Cap 11 is of the press-on type as distinguished from the screw threaded type commonly used for liquid containers. It is operatively mounted on the container by being pushed on over the open neck to the position illustrated in FIG. 4 and 5 which show the internal construction of the cap and the related structure of the container neck on which it is mounted.

The container 16, which may be symmetrical about the axis of the neck, is preferably a blow molded polyethylene unit, usually of about one gallon capacity, having a suitably large body 17 merging to an externally ribbed neck 18 of reduced size. As shown the container neck 18 may be a cylindrical annulus externally formed with an upper peripheral bead 19 and a parallel lower peripheral bead 21 having an annular outwardly open space 22 between them.

The upper bead 19 provides an internal smooth cylindrical sealing surface 23, a flat smooth uniform width annular axial sealing surface 24 which surrounds the neck opening, and an external smooth cylindrical sealing surface 25. Surfaces 23 and 25 are parallel and intersect surface 24 substantially at right angles. Surface 24 is substantially perpendicular to the container neck centerline.

The lower bead 21 as shown may be of generally V-shaped in cross section, having an upper continuous surface 26 that inclines downwardly and outwardly relative to the container axis. The lower surface 27 of bead 21 provides a generally axially facing main cap retainer ledge.

Figure 8:
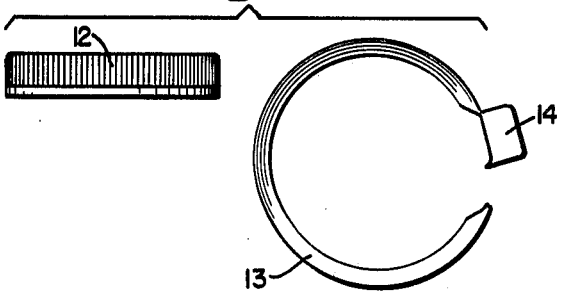
FIG. 8 is an exploded view illustrating the detached tab and lower annular rim and locking ring resulting when the closure is opened.
Figure 2:
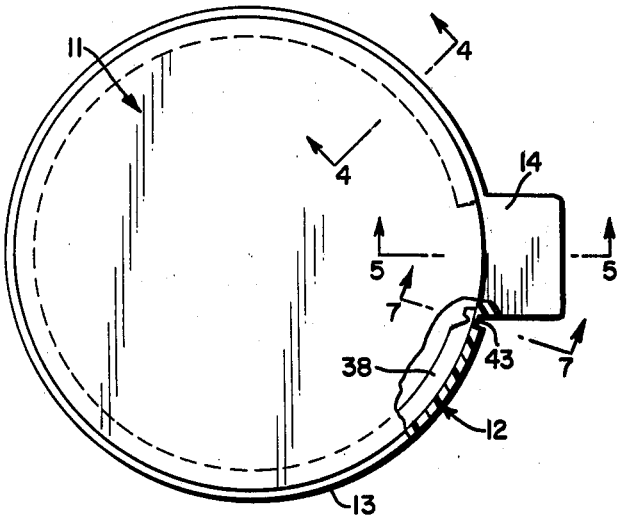
FIG. 2 is a top plan view of the closure cap of FIG. 1, partly broken away and sectioned.
Figure 4:
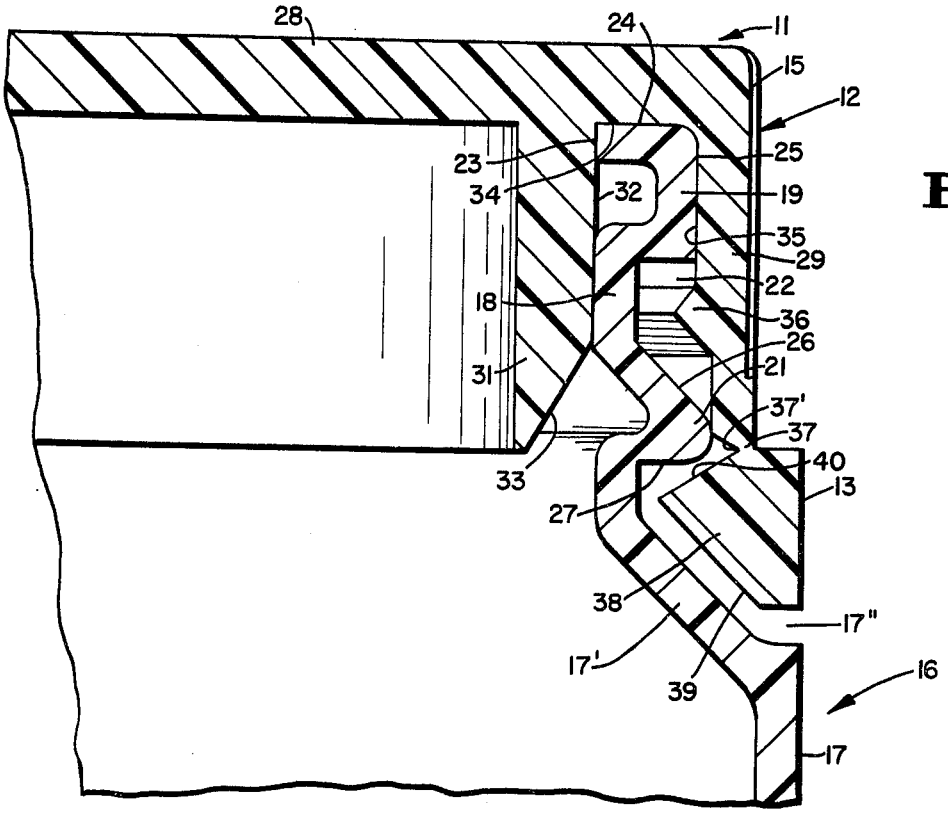
FIG. 4 is an enlarged half section substantially along line 4—4 of FIG. 2 showing the closure cap in its intended environment on the neck of a container.
Figure 5:
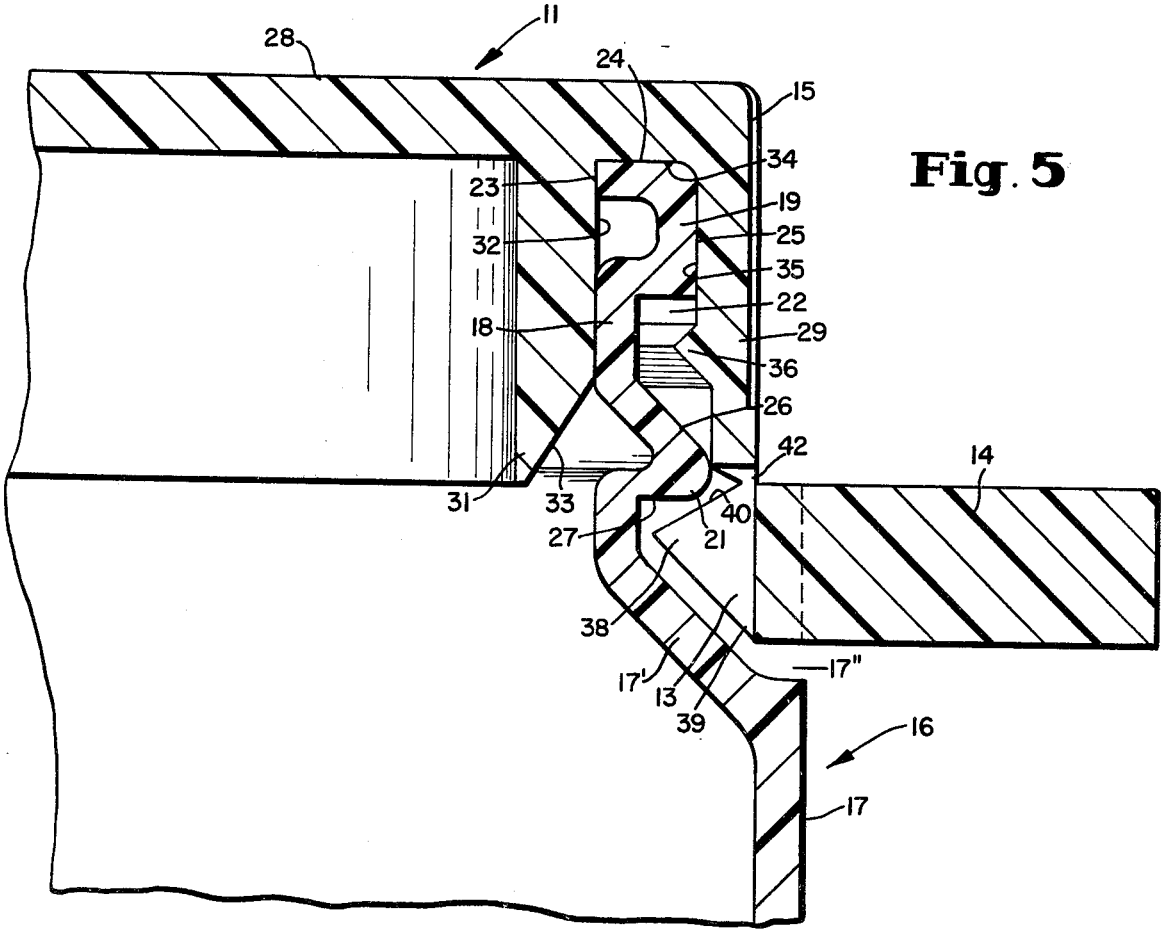
FIG. 5 is an enlarged half section substantially along line 5—5 of FIG. 2 further showing the closure cap in its intended environment.

Cap 11 has the internal construction shown in FIGS. 4 and 5. As shown the cap is cup-shaped, with body 12 having a flat impermeable base 28 adapted to extend over the container neck opening and a substantially cylindrical outer side wall 29. Depending from base 28 is an inner annular wall 31 parallel to wall 29. As shown wall 31 provides a smooth cylindrical sealing surface 32 and its lower end 33 is tapered downwardly and inwardly to provide a guiding function as will appear. Wall 31 is axially shorter than wall 29 in the original assembly of FIG. 1 but has about the same axial extent when rim 13 is detached in the condition of FIG. 8.

Base 28 of the cap is formed between walls 29 and 31 with a flat smooth internal sealing surface 34 that has an axial width about equal to the axial width of the container neck end surface 24. Outer cap side wall 29 is formed internally with a smooth cylindrical sealing surface 35 concentric with surface 32.

As will appear when the cap is pressed onto the container neck, the neck 18 will be guidably received within the walls 29 and 31 and surfaces 23, 32; 24, 34 and 25, 35 will be in firm sealing contact to provide an effective U-shaped liquid tight seal about and around the open end of neck 18.

Below surface 25 and below the level of neck bead 19 in the assembly, the cap body side wall is formed with a continuous inwardly projecting annular locking rib 36, preferably of V-shape in cross section and parallel to base 28. As shown in FIG. 4 the rim portion 13 of the cap is of greater thickness than the body wall 29 and is connected to the lower edge of wall 29 by a circumferentially extending weakened region 37 of reduced thickness of such character that it may rupture to enable rim 13 to be entirely detached from the cap body when desired. Weakened region 37 is preferably provided by an internal groove 37' extending around the wall 29.

Figure 3:
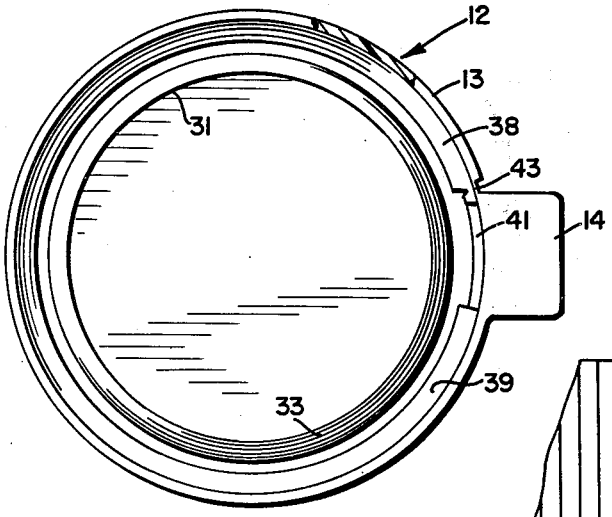
FIG. 3 is a bottom plan view of the closure cap of FIG. 1, partly broken away and sectioned.

As shown in FIGS. 3 and 4 a primary substantially annular locking rib 38 of generally V-shaped in cross section extends around the inner side of ring 13 and projects inwardly a greater distance than rib 36. Rib 38 has a bottom surface 39 inclined oppositely to surface 33 and an upper inclined surface 40 adapted to coact with container bead 21. As shown in FIG. 3, rib 38 is continuous except for a small segmental gap indicated at 41 opposite tab 14.

Figure 6:
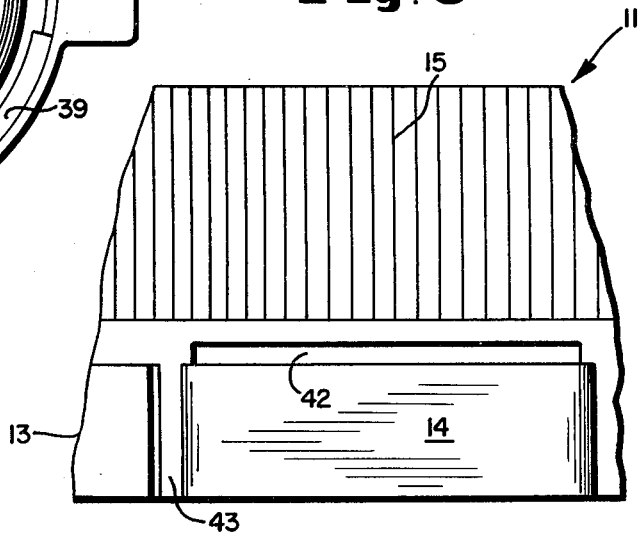
FIG. 6 is a fragmentary end view showing the cap wall slot at the inner end of the release tab.

The function of release tab 14 is to provide a grip and starting point for removal of rim portion 13. To aid in this function the weakened region 37 in the body side wall is slotted at 42 (FIGS. 5 and 6) adjacent and just above rim 13 and the inner end of tab 14 for a distance about equal to the segmental gap 41. There may be one continuous slot or several aligned shorter slots.

Figure 7:
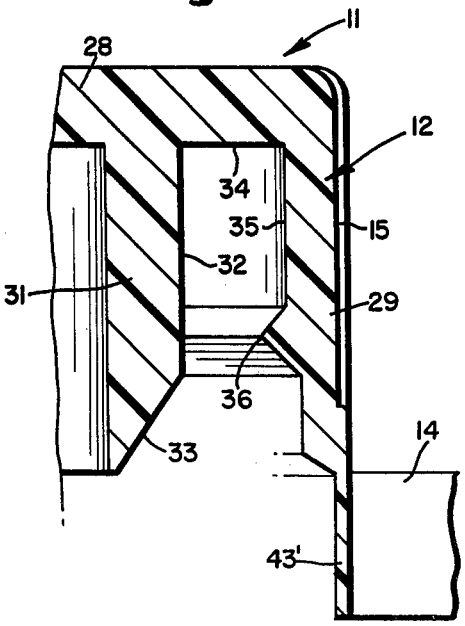
FIG. 7 is a fragmentary section substantially on line 7—7 of FIG. 2 showing the wall structure at the point of initial detachment of the release tab.

A further weakened region in the form of a notch 43 is formed in the rim 13 at one side of its juncture with tab 14 so that there is only a very thin connecting section 43' (FIG. 7) between the rim 13 and the inner corner of the tab 14 at one side of the tab. This notched region coacts with the slot 42 when the tab 14 is gripped and twisted to effectively break the rim 13 and detach it from the body at that point so that an outward pull on the tab will rupture the weakened region 37 all along its length and enable rim 13 to be stripped from the closure cap and thus remove locking rib 38. Tab 14 is of about the same thickness as the rim.

Cap 11 is preferably formed of polyethylene, polypropylene, polyvinyl chloride or other suitable inert synthetic resin that can be molded to the desired shape and posses inherent characteristics of toughness and balanced stiffness and inherent resiliency enabling it to be pressed onto the container neck to the FIG. 4 and 5 position.

As the cap is pushed upon the container neck it is guidably centered by oppositely inclined surfaces 33 and 40, the inherent flexibility of the side wall 29 enabling the ribs 38 and 36 to cam outwardly as they pass the container neck beads 19 and 21 and then restore to initial shape as the parts relate as in FIG. 4. When the cap is pushed on fully a liquid tight seal is formed between it and the upper end of the container neck and the primary locking rib 38 coacts with neck bead 21 to prevent unauthorized removal of the cap from the container.

When it is desired to open the container, the tab 14 is gripped and twisted, rupturing the wall first at notch 43, and then pulled outwardly rupturing the wall along the weakened region 37 until rim 13 is entirely removed from the cap.

The cap now reduced to the body 12 may be readily removed since rib 36 is of only relatively slight inward extent and will cam over the container neck end bead with a slight pull. Once the rim 13 is removed, in the event the container is not emptied, the cap body 12 may be remounted over the container neck bead 36 providing a sufficient holding action to prevent accidental removal of the cap.

The invention provides an inexpensive easily installed closure cap of minimum height that requires minimum of material. It is formed to guide itself reliably to sealed locked position when simply pushed onto the container neck, and it is readily removed with a single twist-pull manipulation of the tab. It can be used on glass as well as plastic container necks.

A feature of the invention is the novel interfit of the cap with the container whereby to prevent manual displacement of the cap without removal of the rim. The container body is formed with an outwardly flared region 17' that extends around below the level of rim 13 of the installed cap so that only a small space 17'' exists between the lower edge of rim 13 and the container wall. This space is so small that it will not accept the fingers of one trying to remove the cap without manipulation of the tab.

In automatic machinery for installation of these caps on a container neck, the caps are usually fed in succession from the bottom of a stack and pushed toward the container neck. A feature of the present invention is the ability of the inclined surface 39 to initially engage the upper bead of the container neck during transfer of the cap onto the container neck and tend to center the cap and ensure that the cap is applied to the neck at least to the extent of engaging rib 36 below the upper bead 19. This ensures that the cap will not be accidentally displaced from the neck as it is being transferred to the next station on the automatic machine where a positive downward push on the cap places it in the final sealed and locked position of FIGS. 4 and 5.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A tamperproof push-on type integral synthetic plastic closure cap for an externally beaded container neck, said cap comprising a body having a depending side wall, a rim on the lower end of said wall having an inwardly projecting locking rib adapted to coact with a bead on the container neck, a circumferential weakened region in said wall disposed above said rim, and a tab projecting away from said rim, there being a slotted region in the cap wall substantially coextensive with said tab and a weakened connecting region between one side of the tab and said rim.

2. The closure cap defined in claim 1, wherein said circumferential weakened region is mainly inwardly open groove means in said wall.

3. The closure cap defined in claim 1 wherein said tab comprises in effect a portion of said rim and said weakened connecting region is a notched region between said rim and an inner corner of said tab.

4. The closure cap defined in claim 1, wherein said slotted region is a portion of said weakened region adjacent and substantially coextensive with said tab.

5. The closure cap defined in claim 1, wherein said cap comprises a top and said depending side wall is a cap outer side wall depending from said top and there is a depending annular inner side wall within the cap, with surfaces on said inner side wall, the top of said cap and the outer cap side wall adapted for forming a U-shaped liquid tight seal with the upper end of said container neck when the cap is pushed onto said neck to locking position.

6. The closure cap defined in claim 1, wherein said rim is thicker in cross section than the remainder of said cap side wall.

7. The closure cap defined in claim 1, wherein said locking rib has a downwardly and outwardly inclined lower surface effective for guiding and deflecting the cap side wall as the cap is pushed onto the container neck, and an upper inwardly extending surface adapted to assume a cap locking position under a bead on said container neck.

8. The closure cap defined on claim 1, wherein there is an intermediate smaller locking rib on the container side wall above said circumferential weakened region adapted for coaction with a bead on said container neck for enabling the cap body to be reused as a closure when the rim has been detached.

9. In combination with the closure cap defined in claim 1, a container having said cap installed on the beaded neck thereof, and said container having a wall portion extending around below and only slightly spaced from said rim whereby to prevent entry of fingers or the like for unauthorized removal of the cap.

* * * * *